US008251741B2

(12) United States Patent
Yang et al.

(10) Patent No.: US 8,251,741 B2
(45) Date of Patent: Aug. 28, 2012

(54) ELECTRICAL CONNECTOR INTEGRALLY FORMED WITH SCREW HOLES

(75) Inventors: Wen-Huei Yang, Tu-Cheng (TW); Chun-Chi Chen, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 243 days.

(21) Appl. No.: 12/786,451

(22) Filed: May 25, 2010

(65) Prior Publication Data

US 2010/0297890 A1 Nov. 25, 2010

(30) Foreign Application Priority Data

May 25, 2009 (TW) ..... 98117311 A

(51) Int. Cl.
*H01R 13/73* (2006.01)

(52) U.S. Cl. ..... 439/567

(58) Field of Classification Search ..... 439/564, 439/567, 571, 331, 345, 573, 660
See application file for complete search history.

(56) References Cited

U.S. PATENT DOCUMENTS 5,797,769 A * 8/1998 Yang et al. ..... 439/571
6,386,910 B1 * 5/2002 Yu ..... 439/567
8,033,861 B2 * 10/2011 Zhu ..... 439/567

FOREIGN PATENT DOCUMENTS

CN 201194294 2/2009
TW M345400 11/2008

* cited by examiner

*Primary Examiner* — Chandrika Prasad
(74) *Attorney, Agent, or Firm* — Wei Te Chung; Andrew C. Cheng; Ming Chieh Chang

(57) ABSTRACT

An electrical connector includes a plurality of terminals and an insulating housing loading terminals and defining a pair of mounting portions. Each of mounting portions has a screw hole extending along an upper to lower direction in which the electrical connector is mounted. The hole is divided into at least a first segment and a second segment below the first segment. The first segment and the second segment are tapped with a plurality of threads thereinside and open in opposite directions along a front and rear direction respectively.

11 Claims, 5 Drawing Sheets

ELECTRICAL CONNECTOR INTEGRALLY FORMED WITH SCREW HOLES

BACKGROUND OF THE INVENTION

1. Field of the Invention

The present invention relates to an electrical connector, and more particularly to an electrical connector integrally formed with a pair of screw holes to receiving board-locking bolts.

2. Description of Related Art

An engagement of bolt and nut to retain an electrical connector on a PCB is well known to the skill in the art. Chinese Utility Issue No. 201194294Y issued on Feb. 11, 2009 to Tian-Qing Cai discloses an electrical connector, which has a pair of nut embedding holes to receive screw nuts so that bolts can tighten in the nuts to retain the connector on the PCB. A rearward opening demoulding channel and a forward opening demoulding channel are defined above and below the nut embedding hole. From a top planar view of the electrical connector, said two channels overlap partially, thus an upright through hole is limited to contain the bolt. The manner of said engagement is believed to be high cost since two nuts are needed.

Tainwan Utility Pat. No. TW345400 issued on Nov. 21, 2008 to ACES ELECTRONIC CO., LTD discloses an electrical connector, which has a pair of through holes integrally formed in the insulating housing. The threads in the through hole run though the whole hole. However, the mold used for injection molding of the hole must be demoulded along the rotation direction of the threads inside the hole. As known, it is a complex method to demould the mold.

It is thus desired to provide an electrical connector to overcome the disadvantage of the related art.

SUMMARY OF THE INVENTION

Accordingly, an object of the present invention is to provide an electrical connector with lower cost and simple demoulding method.

In order to achieve the above-mentioned object, an electrical connector comprises a plurality of terminals and an insulating housing loading the plurality of terminals and defining a pair of mounting portions. Each of mounting portions has a screw hole extending along an upper to lower direction in which the electrical connector is mounted. The hole is divided into at least a first segment and a second segment below the first segment. The first segment and the second segment are tapped with a plurality of threads thereinside and open in opposite directions along a front and rear direction respectively.

Other objects, advantages and novel features of the present invention will become more apparent from the following detailed description of the present embodiment when taken in conjunction with the accompanying drawings.

DETAILED DESCRIPTION OF THE INVENTION

The present invention will now be described in detail with reference to a preferred embodiment thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps have not been described in detail in order to not unnecessarily obscure the present invention.

Figure 1:
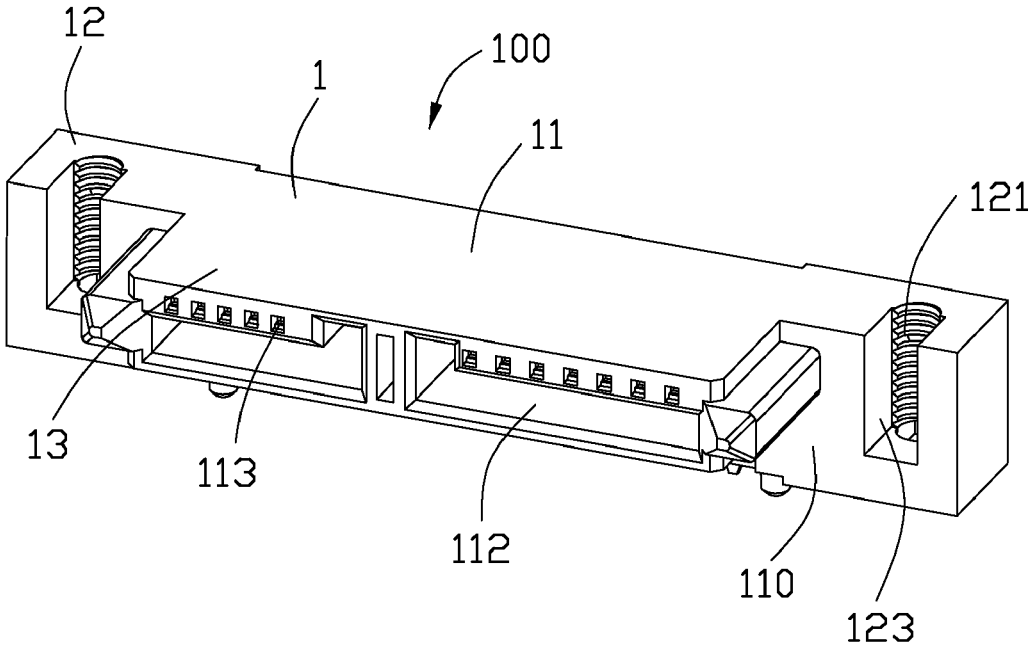
FIG. 1 is a top and front perspective view of an electrical connector according to an embodiment of the present invention.
Figure 2:
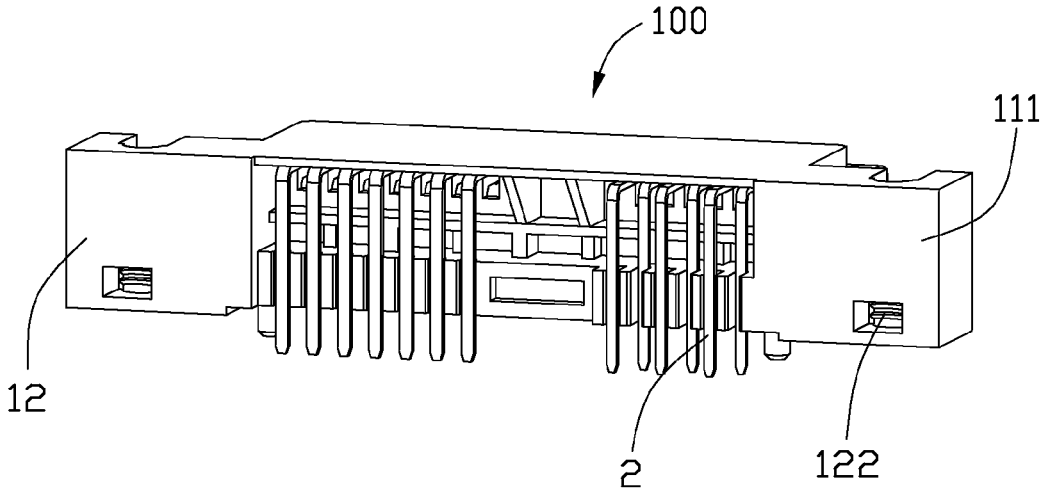
FIG. 2 is a top and rear perspective view of the electrical connector shown in FIG. 1.
Figure 3:
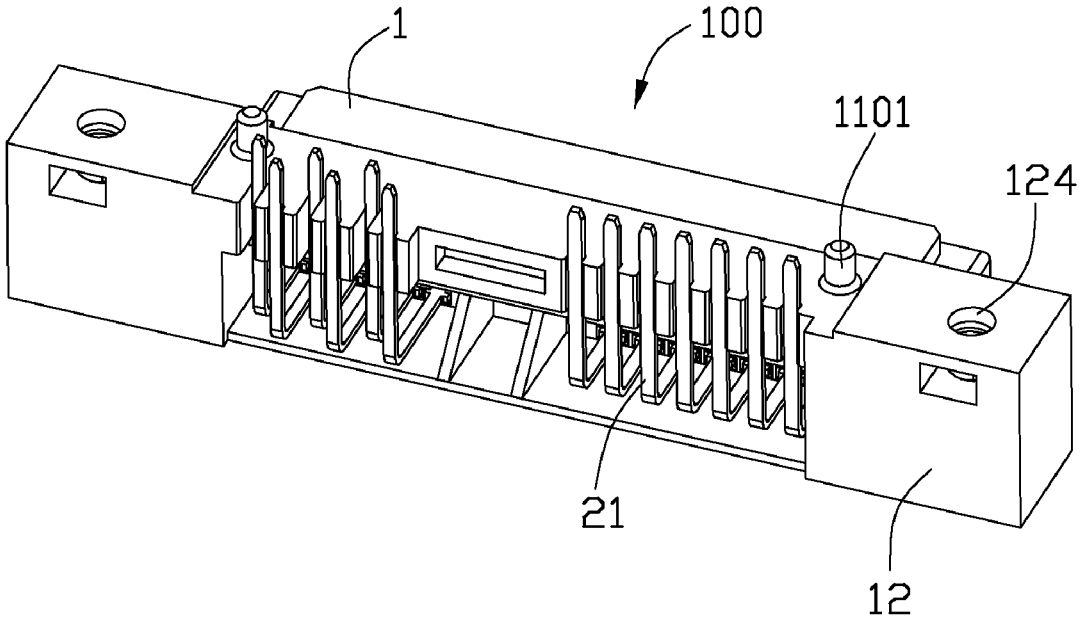
FIG. 3 is a bottom and rear perspective view of the electrical connector shown in FIG. 1.

Referring to FIGS. 1 through 3, an electrical connector 100 made in accordance with the present invention includes a rectangular insulating housing 1 with a plurality of terminals 2 arranged in the housing. The insulating housing 1 includes a rear base portion 11, a mating portion 13 extending forwards from a front face 110 of the base portion 11. The mating portion 13 has two separated L shaped mating slots 112 side by side and a plurality of passageways 113 extending from the rear face 111 of the base portion to the front face 110 of the mating portion at the top wall of the mating slots. The terminals 2 are received in the passageways and the solder legs 21 extend downwards along the rear face of the base portion 11. Two end portions of the base portion 11 extending beyond the mating portion 13 are defined as mounting portions 12 which are used for loading a pair of board-lock members, such as screw bolts (not shown) in the screw holes 121. A pair of positioning posts 1101 integrally project downwards from the base portion 11 adjacent to the mounting portions 12. The mounting portions 12 are lower than the base portion 11 slightly.

Figure 4:
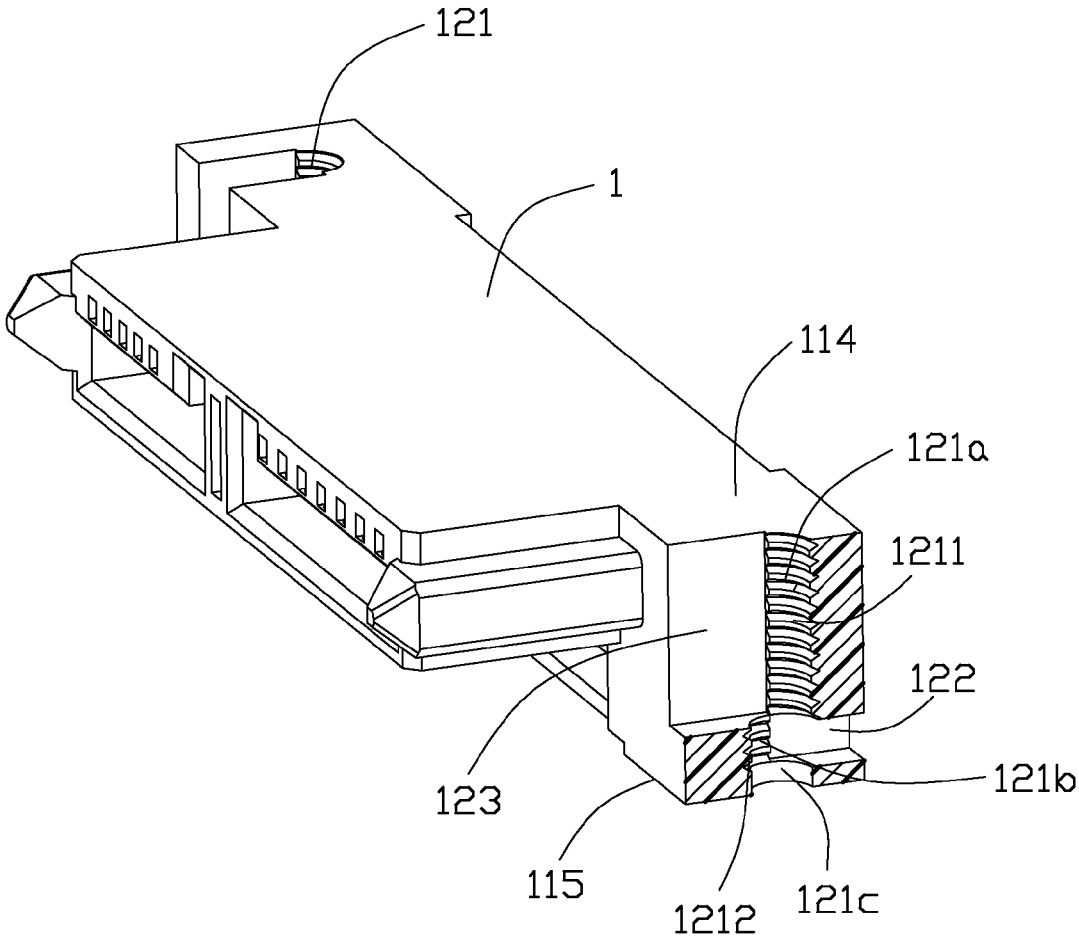
FIG. 4 is a top and front perspective view of the electrical connector shown in FIG. 1, which is cut away partially to show the hole.
Figure 5:
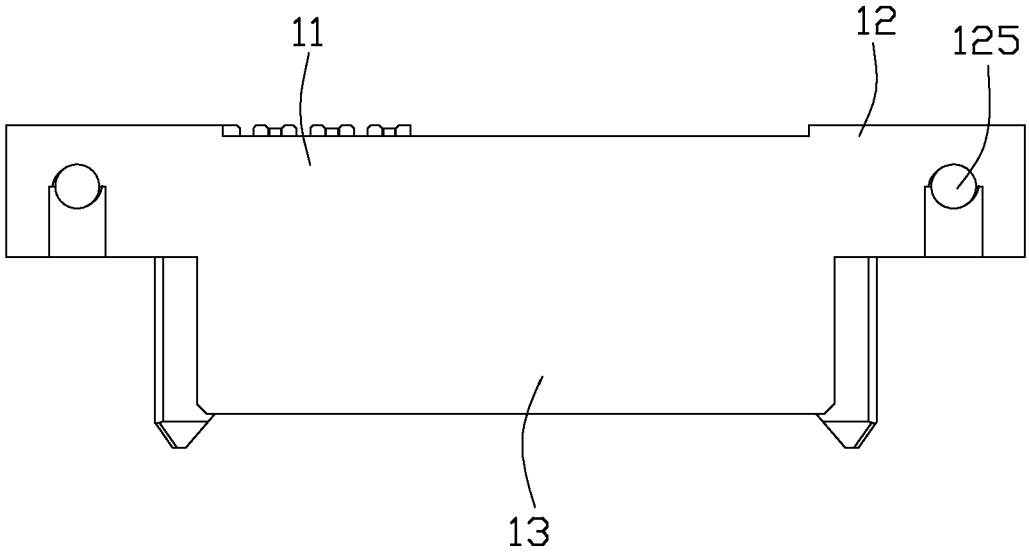
FIG. 5 is a top planar view of the electrical connector shown in FIG. 1.

Referring to FIG. 4, each of the screw holes 121 run through the top face 114 and the bottom face 115 of the mounting portion 12. The hole 121 is divided into three segments, first or upper segment 121*a*, second or middle segment 121*b* and third or lower segment 121*c*. The top segment 121*a* opens forwards through a first demoulding channel 123 which communicates with a front exterior through a front face 110 of the base portion and the top segment of the hole 121. The middle portion 121*b* opens rearward through a second demoulding channel 122 which communicates with a rear exterior through a rear face 111 of the base portion and the middle portion 121*b*. The first and the second demoulding channels start at a semicircle of screw hole 121. In other word, the screw hole is remained only in one semicircle form. The remainder portion of the upper segment 121*a* and the middle segment 121*b* of the hole are formed with threads 1211, 1212 while the lower segment 121*c* has smooth inside without threads. The upper segment 121*a* is in a first semicircle tapping form in the rear of the mounting portion 12 and the middle segment is in a second semicircle tapping form in the front of the mounting portion. The lower segment 121*c* is in a smooth circle column 124 shown in FIG. 3. The middle segment 121*b* is below and shorted than the upper segment 121*a* in the upper to lower direction. From a top view of the connector as shown in FIG. 5, the first and the second segments commonly form a complete circle column hole 125. The first and second channels are adapted for demoulding of the mold after injection forming of holes 121.

The bolts (not shown which is well known) are inserted into the screw holes 121 from the bottom face 115 to the top face 114, a stud of the bolt is received in the hole. The smooth circle column 124 benefits the pistol of the bolt.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

a plurality of terminals;

an insulating housing loading the plurality of terminals and defining a pair of mounting portions each of which has a screw hole extending along an upper to lower direction in which the electrical connector is mounted;

the hole divided into at least a first segment and a second segment below the first segment, the first segment and the second segment are tapped with a plurality of threads thereinside and open in opposite directions along a front and rear direction respectively.

2. The electrical connector as described in claim 1, wherein the first segment is in a first semicircle tapping portion in a top view of the electrical connector and the second segment is in a second semicircle tapping form in the top view, said first and second semicircle tapping portion face to each other and offset in the upper to lower direction.

3. The electrical connector as described in claim 2, wherein a third segment is defined below the second segment and is in a smooth circle inside in the top view of the electrical connector.

4. The electrical connector as described in claim 3, wherein said three segments has a same diameter.

5. The electrical connector as described in claim 4, wherein a length of the second segment along the upper to lower direction is larger than that of the third segment while smaller than that of the first segment of the screw hole.

6. The electrical connector as described in claim 5, wherein the first segment opening forwards through a first demoulding channel and the second segment opening forward through a second demoulding channel, the length of the first segment along the upper to lower direction is same to that of the first demoulding channel and the length of the second segment is same to that of the second demoulding channel.

7. An electrical connector mounted on a board in a first direction by a pair of bolts inserted in to the electrical connector in a second direction opposite to the first direction, comprising:

an insulating housing arranged with a plurality of terminals therein and defining a first channel and a second channel below the first channel in the first direction;

the first channel running through one of a front face and a rear face of the insulating housing and having a semicircle inside integrally formed with threads;

the second channel running through the other of the front face and the rear face of the insulating housing and having a semicircle inside integrally formed with threads;

wherein said two semicircle insides overlap in the first direction to commonly for a circle.

8. The electrical connector as recited in claim 7, wherein a smooth hole without threads thereinside is defined below the second channel to overlap said circle.

9. A process of forming an electrical connector which comprises an insulative housing with at least one screw hole defined at least by a first part having an interior surface of one half cylindrical configuration with first threads thereon facing toward an exterior in a first direction, and a second part having another interior surface of the other half cylindrical configuration with second threads thereon facing toward the exterior in a second direction opposite to the first direction under condition that said first part and said second part are axially offset from each other and a pitch of said first threads is same with that of the second threads, comprising steps of:

providing a male mold with means for forming said first threads;

providing a female mold with means for forming said second threads under condition that said female mold is back and forth moveable relative to the mal mold in the first direction;

injection molding the housing including said screw hole with said first threads and said second threads thereon under one procedure.

10. The process of forming the connector as claimed in claim 9, wherein said screw hole further defines a section without any threads thereon.

11. The process of forming the connector as claimed in claim 10, wherein said section without threads thereon is located at a front end thereof, where a corresponding screw first reaches during inserting said screw into the screw hole.

* * * * *